US006364672B1

(12) United States Patent
Miyazoe et al.

(10) Patent No.: US 6,364,672 B1
(45) Date of Patent: Apr. 2, 2002

(54) POWER-SUPPLY UNIT HAVING CONNECTOR OF VARIABLE ORIENTATIONS

(75) Inventors: Shinji Miyazoe; Makoto Ishikawa, both of Ibaraki (JP)

(73) Assignee: SMC Corporation, Tokyo (JP)

( * ) Notice: Subject to any disclaimer, the term of this patent is extended or adjusted under 35 U.S.C. 154(b) by 0 days.

(21) Appl. No.: 09/668,361

(22) Filed: Sep. 25, 2000

(30) Foreign Application Priority Data

Oct. 18, 1999 (JP) ..... 11-295975

(51) Int. Cl.[7] ..... H01R 13/44; H01R 13/60
(52) U.S. Cl. ..... 439/131; 439/534; 439/713
(58) Field of Search ..... 439/131, 534, 439/713, 567, 347

(56) References Cited

U.S. PATENT DOCUMENTS

| | | | | |
|---|---|---|---|---|
| 4,268,100 A | * | 5/1981 | Kekas et al. | 439/131 |
| 4,671,600 A | | 6/1987 | Sawai et al. | 439/221 |
| 4,850,882 A | | 7/1989 | Yu | 439/31 |
| 4,929,192 A | * | 5/1990 | Beghelli | 439/131 |
| 4,997,381 A | | 3/1991 | Oh | 439/172 |
| 5,706,858 A | | 1/1998 | Miyazoe et al. | 137/884 |
| 5,795,187 A | | 8/1998 | Sipe | 439/567 |

FOREIGN PATENT DOCUMENTS

JP 9-133240 5/1997

OTHER PUBLICATIONS

"Surface Mounted Pivoting Card Edge Connector." Research Disclosure, Kenneth Mason Publications Ltd, Dec. 1986.*

* cited by examiner

*Primary Examiner*—Brian Sircus
*Assistant Examiner*—Hae Moon Hyeon
(74) *Attorney, Agent, or Firm*—Oblon, Spivak, McClelland, Maier & Neustadt, P.C.

(57) ABSTRACT

A power-supply unit for a solenoid valve assembly wherein the position of installation of the multielectrode connector can be easily changed in a simple manner. In order to achieve this object, the power-supply unit comprises a base to be mounted on one end of the solenoid valve assembly including a plurality of solenoid valves arranged in a row, a connector frame to be fitted on the base, and a multielectrode connector mounted on the connector and electrically connected to each solenoid valve for supplying power. In the power-supply unit, the connector frame is rotatably supported on the base so that the position of the socket connection with respect to the multielectrode connector can be switched between an upright position and a horizontal position. Therefore, a mechanism for releasably locking the connector frame in either on of the two positions by engagement is provided between the connector frame and the base.

3 Claims, 4 Drawing Sheets

POWER-SUPPLY UNIT HAVING CONNECTOR OF VARIABLE ORIENTATIONS

CROSS-REFERENCE TO RELATED APPLICATIONS

This application is related to and claims priority, under 35 U.S.C. § 119, from Japanese Patent Application No. 11-295975, filed on Oct. 18, 1999, the entire contents of which are hereby incorporated by reference herein.

BACKGROUND OF THE INVENTION

1. Field of the Invention

The present invention relates to a power-supply unit for supplying power to a solenoid valve assembly comprising a plurality of solenoid valves arranged in a row.

2. Discussion of Background

In a solenoid valve assembly comprising a plurality of solenoid valves arranged in a row, power is generally supplied to each solenoid valve simultaneously via a multielectrode connector. However, when the orientation of the multielectrode connector attached to the solenoid valve assembly is limited to one of an upward orientation and a horizontal orientation, it is sometimes difficult to connect the socket depending on the position or the direction where the solenoid valve assembly is installed.

As a measure to solve this problem, Japanese Unexamined Patent Application Publication No. 9-133240 disclosed a connector that can be attached to the solenoid valve assembly selectively in the upright or the horizontal position. However, it has been desired to provide a solenoid valve assembly in which the direction of the multielectrode connector with respect to the solenoid valve assembly can be changed more easily.

DISCLOSURE OF THE INVENTION

Accordingly, it is an object of the present invention to provide a power-supply unit for a solenoid valve assembly wherein the position of the multielectrode connector attached thereon can be easily changed in a simple manner.

More specifically, it is an object of the present invention to provide a power-supply unit for a solenoid valve assembly in which the direction of the connector frame can be changed simply by sliding a locking member provided on the base.

In order to achieve the above objects, the present invention provides a power-supply unit for a solenoid valve assembly comprising a base to be mounted on one end of the solenoid valve assembly including a plurality of solenoid valves arranged in a row, a connector frame to be fitted on said base, and a multielectrode connector mounted on said connector and electrically connected to each solenoid valve for supplying power, characterized in that the connector frame is rotatably supported on the base so that the position of the socket connection with respect to the multielectrode connector can be switched between an upright position and a horizontal position, and in that an engaging locking means for releasably locking the connector frame in either one of said two positions by engagement is provided between said connector frame and the base.

Specifically, the locking means of the power-supply unit comprises a pivot of circular cross section for rotatably supporting the connector frame on the base, a square pivot member attached to the pivot, a part of which is formed in a square shape, and a locking member provided on the base and moving between a locked position where the locking member abuts against the flat face portion of the square pivot member and a released position where it is released from the locked state. The locking member can be made movable between the locked position and the released position by providing a square pivot member on the connector frame at a position adjacent to and coaxial with the pivot of circular cross section, and providing the locking member mounted on the base with a flat portion for restraining the rotation of the pivot when abutted against the flat face portion of the square pivot member, and enabling the locking member to slide along the axis of rotation.

More specifically, in the power-supply unit for a solenoid valve assembly, the base is provided with a bearing portion that rotatably supports the lower half of the pivot and a flat supporting portion for supporting the square pivot member, and the locking member is provided with a pivot holder moving between the pivot and a square pivot member by sliding movement in the direction of the axis of the pivot, so that the connector frame is locked in the locked position where the square pivot member is interposed between the flat portion of the pivot holder and the flat supporting portion and is rotatable at the position where the interposition of the square pivot member is released.

In the power-supply unit for a solenoid valve assembly having such a structure, the position of the connector frame can be locked by sliding the locking member provided on the base and interposing the square pivot member between the flat portion of the pivot holder and the flat supporting portion of the base, and the connector frame can be rotated by moving the pivot holder onto the pivot on the connector frame to release the interposition of the square pivot member.

Therefore, the position of the connector frame can be changed simply by sliding the locking member provided on the base.

DESCRIPTION OF THE PREFERRED EMBODIMENT

FIG. 1 to FIG. 6 show an embodiment of a power-supply unit for a solenoid valve assembly according to the present invention.

Figure 3:
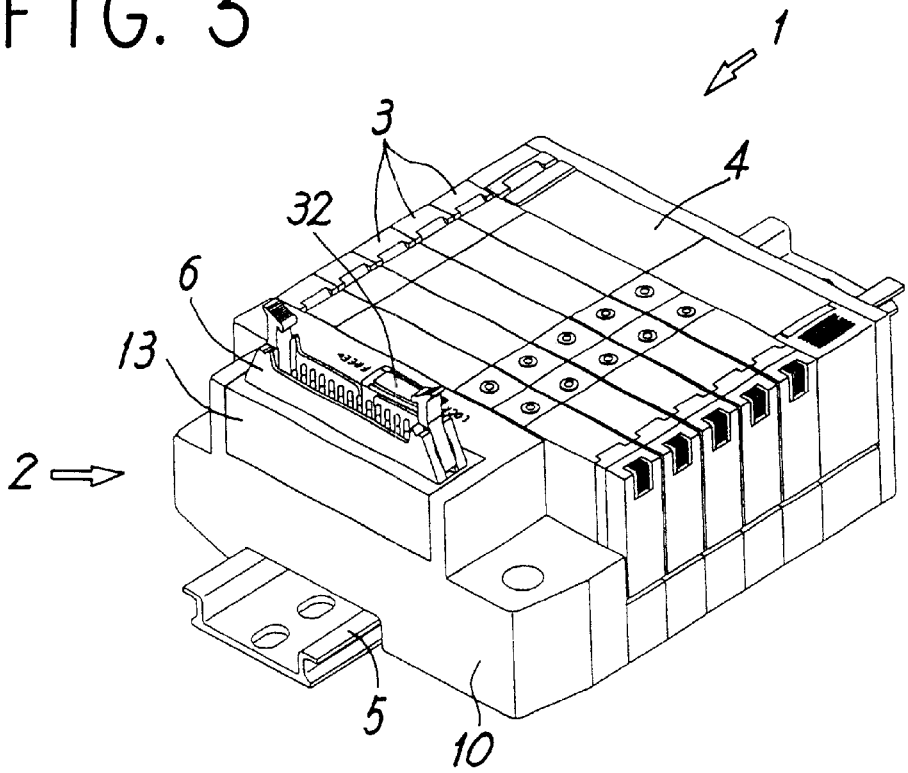
FIG. 3 is a perspective view showing the state where the power-supply unit of the embodiment shown in FIG. 1 is attached to the solenoid valve assembly.

As shown in FIG. 3, a solenoid valve assembly 1 including a power-supply unit 2 comprises a plurality of solenoid valves 3 connected with respect to each other, the power-supply unit 2 described above mounted on one side thereof, and an air charging and exhausting block 4 mounted on the other side thereof, all of which are connected with respect to each other by being fixed together on the mounting rail 5. The multielectrode connector 6 of the power-supply unit 2 for supplying power is electrically connected to the power-receiving terminal of each solenoid valve by a lead via the internal connector (not shown).

Figure 1:
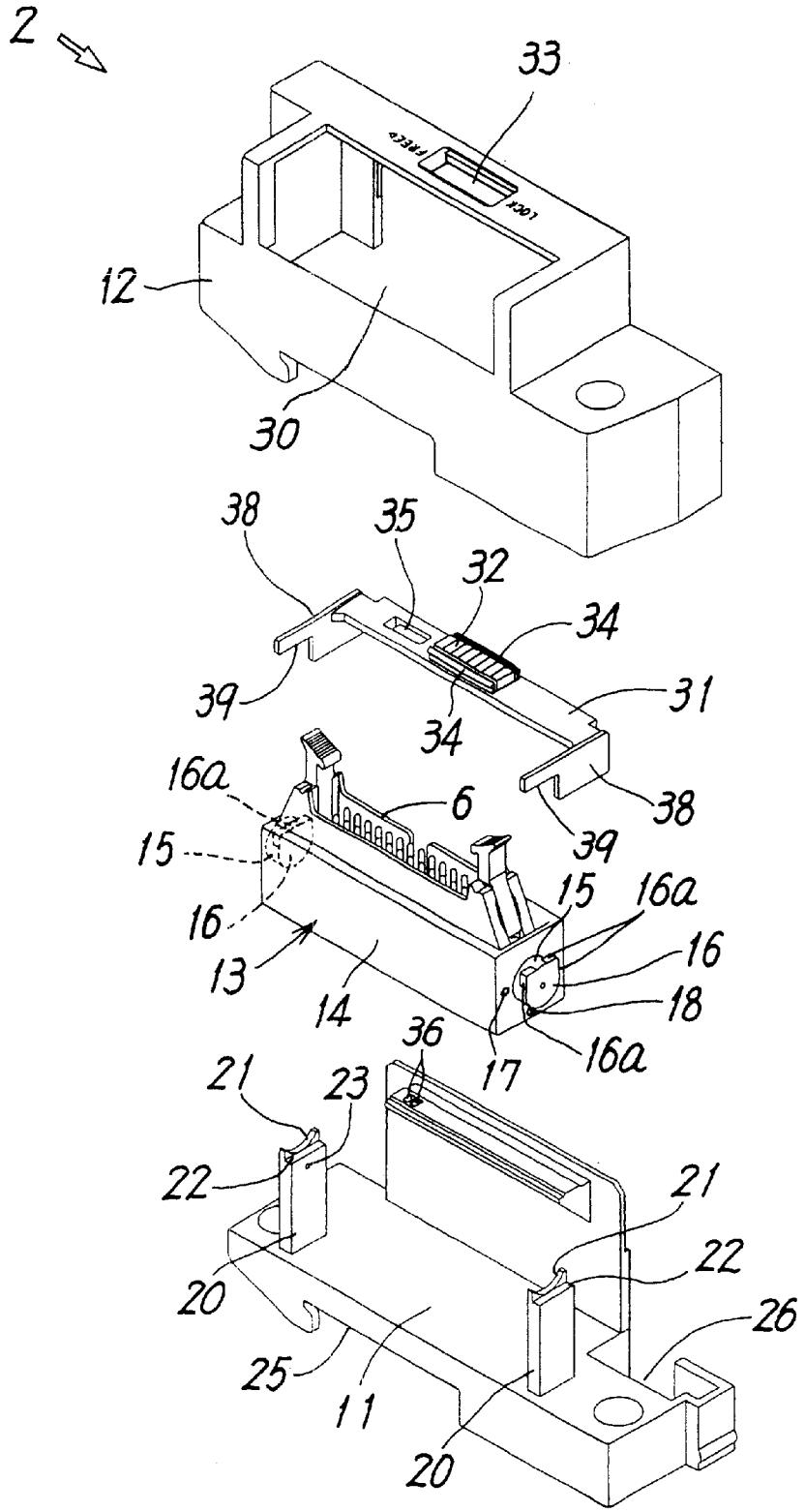
FIG. 1 is an exploded perspective view showing an embodiment of a power-supply unit for a solenoid valve assembly according to the present invention.
Figure 2:
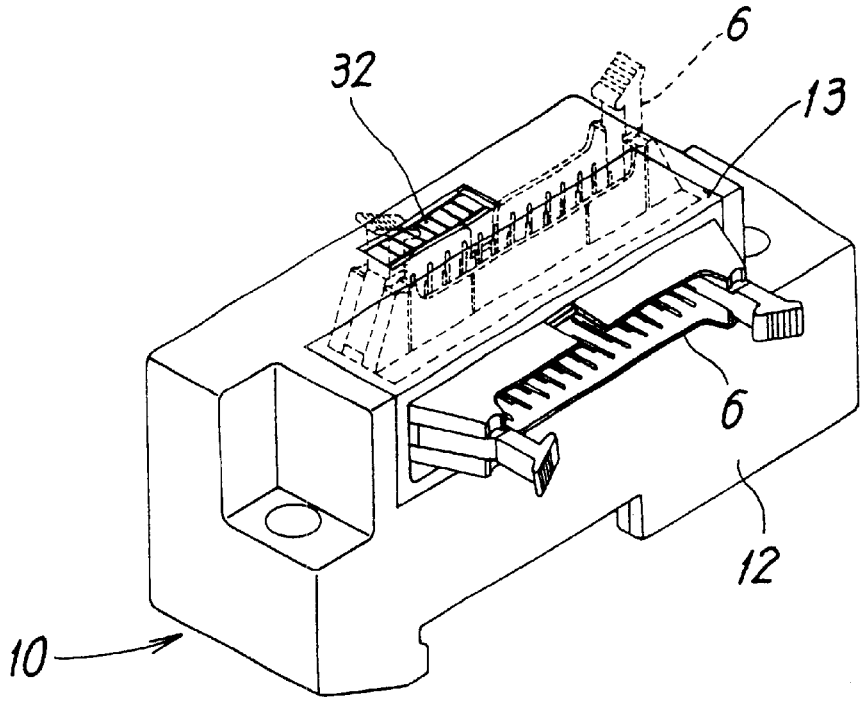
FIG. 2 is a perspective view showing the assembled state of the embodimnt shown in FIG. 1.

As shown in FIG. 1 and FIG. 2 in detail, the power-supply unit 2 comprises a base 10 composed of a bed portion 11 and a cover portion 12, and mounted on one end of the solenoid valve assembly, a connector frame 13 to be rotatably mounted on the base 10, and the above described multielectrode connector 6 fixedly mounted on the connector frame 13 for supplying power.

The connector frame 13 comprises pivots 15 of circular cross section on both sides of the main body 14, and square pivot members 16 mounted respectively at one axial end of respective pivots for providing flat surfaces thereat, respectively, so that orientation of the socket receiving portion of the multielectrode connector 6 supported on the base 10 can be selectively changed between an upward orientation and a horizontal orientation (positions shown by solid lines and by phantomlines). The square pivot members 16 are located outside the pivot 15 on one end of the connector frame 13, and inside the pivot 15 on the other end of the connector frame 13, and the axial length of these pivots 15 and square pivot members 16 on both sides are identical. The square pivot member 16 is square at the upper half and circular at the lower half corresponding to the pivot 15 in the state where the multielectrode connector 6 is in an upright position, and the square portion thereof defines the flat face portion 16*a* of the square pivot member 16. Around the pivots 15 and the square pivot members 16 on both end surfaces of the main body 14 of the connector frame 13, there are provided small positioning holes 17 and 18 as shown in FIG. 1.

The base 10 is composed of a bed portion 11 and the cover portion 12 connected by means of projections and recesses (not shown) into a single unit.

Near both ends of the bed portion 11 that constitutes the base, there is provided a pair of bearing posts 20 standing upward, as is clearly shown in FIG. 1, and the tip of each bearing post is formed with a bearing portion 21 of semi-circular shape for rotatably supporting the lower half portion of the circular post 15 on the connector frame 13, and adjacent to the bearing portion 21, there is formed a flat supporting portion 22 for supporting the square pivot member 16 attached to the pivot 15. In this way, the bearing portion 21 and the flat supporting portion 22 are formed corresponding to the pivot 15 and the square pivot member 16, respectively. The pair of bearing posts 20 are spaced so that the inner opposing surfaces thereof come into contact with both end surfaces of the connector frame respectively, and each of the respective inner opposing surfaces of the bearing posts 20 is provided with a small projection 23 that resiliently engages one of the small holes 17 and 18 formed on the connector frame 13 to acknowledge being at one of the two positions where the socket receiving portion (not shown) of the multielectrode connector 6 faces an upright orientation and where the same faces a horizontal orientation, as shown in FIG. 2, when the direction of the connector frame 13 is changed between these two positions.

The bed portion 11 is formed with a rail groove 25 to be fixed on the mounting rail 5, and an opening 26 through which a lead for connecting the multielectrode connector 6 to each solenoid valve 3 on the side which comes into contact with the solenoid valve 3.

The cover portion 12 to cover the bed portion 11 of the base is provided with an opening 30 of a size through which the multielectrode connector 6 can be exposed in the above described two directions by rotating the connector frame 13, and a releasably engaging locking means for locking the connector frame 13 into any one of the two positions in cooperation with the square pivot member 16 on the connector frame 13 and the flat supporting portion 22 of the bearing post 20.

The locking member 31 constituting a part of the locking means is supported by the cover portion 12 so as to be able to slide in the direction of the axis of the pivot 15 on the connector frame 13, and a pair of locking ridges 34 and 34 for resiliently engaging with the edges of the opening 33 for receiving the locking member are provided on both sides of the final control element 32 on the upper surface thereof. The locking member 31 is slidably maintained in contact with the connector frame 13, and a cantilever resilient strip 35 provided on the reverse side thereof has a small projection (not shown) projecting on the reverse side. The locking member 31 may be held in two positions, that is, the locked position where the rotation of the connector frame 13 is locked and the released position where the connector frame 13 can rotate, by sliding it to the positions where the small projection is engaged with any one of two engaging holes 36 formed on the back cover of the bed portion 11.

Figure 4:
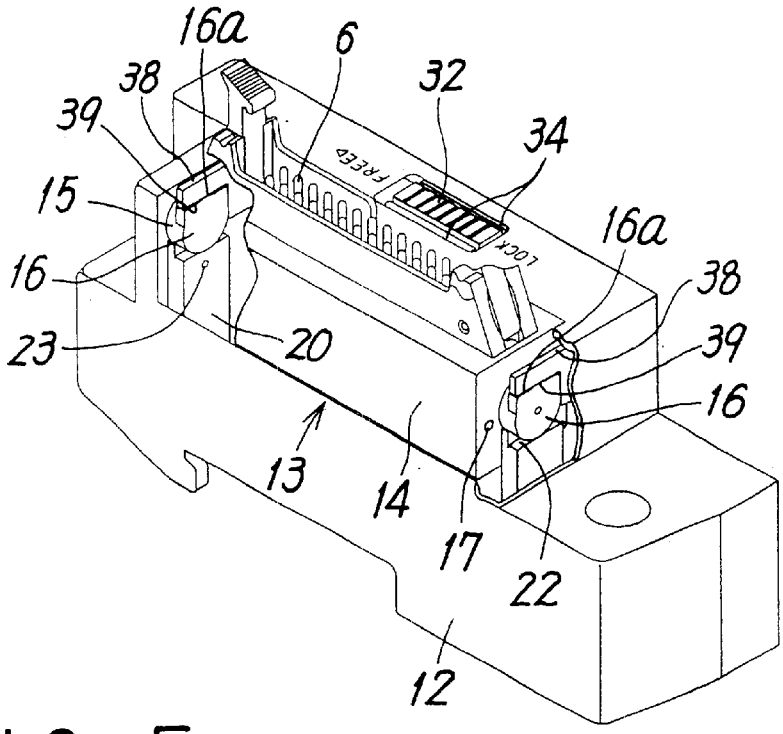
FIG. 4 is a perspective view, partly broken, of the embodiment shown in FIG. 1 showing the state where the multielectrode connector is locked in the upright position.
Figure 6:
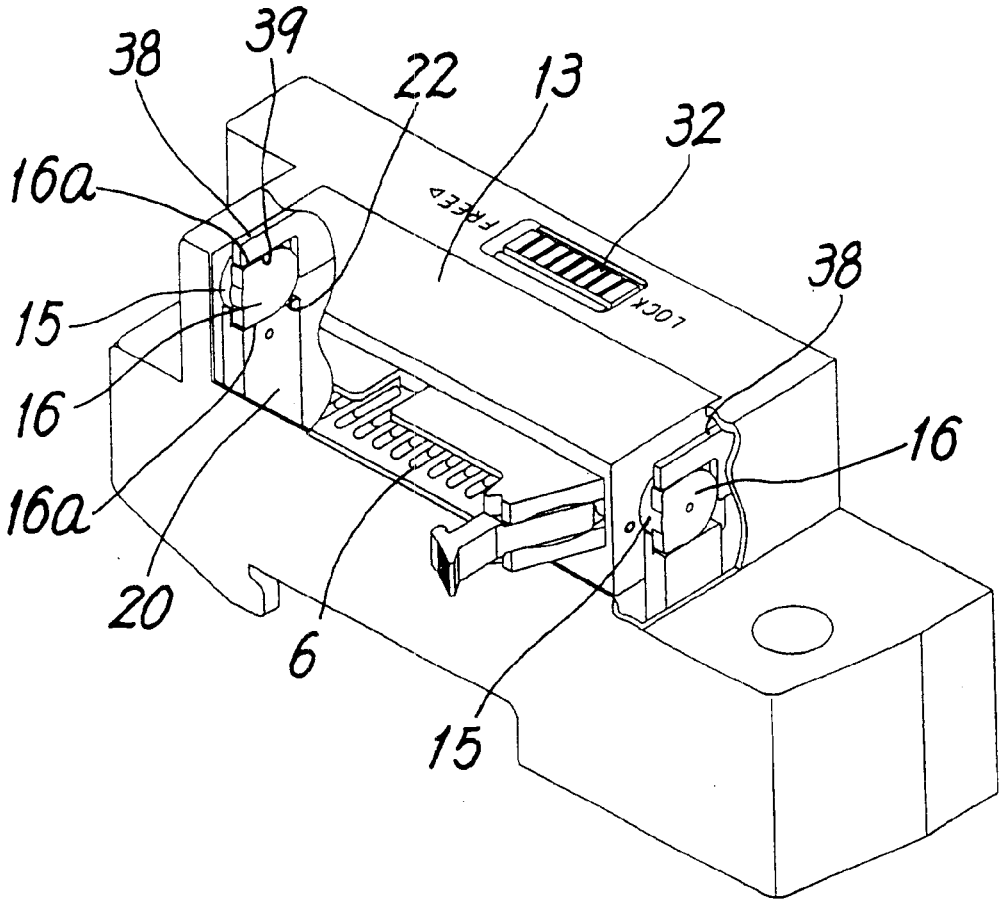
FIG. 6 is a perspective view, partly broken, showing the state where the multielectrode connector is locked in the horizontal position.

At both ends of the locking member 31, there are provided pivot holders 38 that are movable between the top of the pivots 15 and the top of the square pivot members 16 provided on both ends of the connector frame 13. The pivot holder 38 includes a flat portion 39 for restraining the rotation of the connector frame 13 by abutting against the flat face portion 16*a* of the square pivot member 16. When the flat portion 39 is in contact with the flat face portion 16*a* of the square pivot member 16 as shown in FIG. 4 as a result of sliding movement of the locking member 31, the rotation of the connector frame 13 is locked. As shown in FIG. 6, when the flat face portion 16*a* of the square pivot member 16 is interposed between the pivot holder 38 and the flat supporting portion 22 of the bearing post 20, the rotation of the connector frame 13 is also locked.

Figure 5:
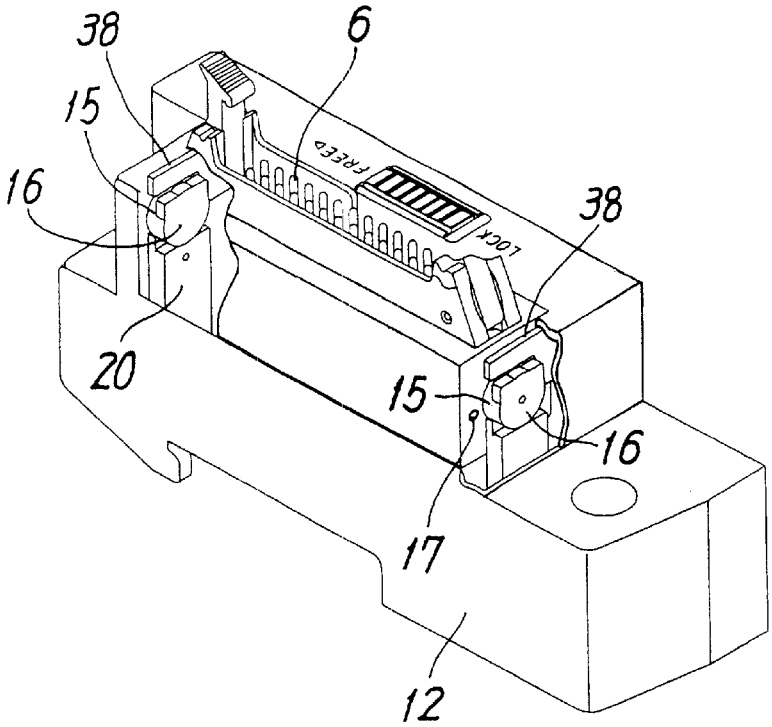
FIG. 5 is a perspective view, partly broken, showing the state where the multielectrode connector is free to rotate.

FIG. 4 shows a state in which the connector frame 13 is locked in an upright position with the flat portion 39 of the pivot holder 38 abutted against the square pivot member 16, and FIG. 6 shows a state in which the connector frame 13 is locked in a horizontal position with the flat portion 39 of the pivot holder 38 abutted against another flat face portion 16*a* of the square pivot member 16, and FIG. 5 shows a state in which the connector frame 13 is free to rotate when the pivot holder 38 moves on top of the pivot 15, which is a released position.

In this way, by moving the pivot holder 38 of the locking member 31 between the top of the pivot 15 and the top of the square pivot member 16, the locking member is selectively switched between the locked position where the locking member abuts against the square pivot member 16 and the rotatable position where the locked state is released.

In the power-supply unit 2 for a solenoid valve assembly in this arrangement, the position of the connector 13 can be locked by sliding the locking member 31 provided on the base 10 and interposing the square pivot member 16 between the flat portion 39 of the pivot holder 38 and the flat supporting portion 22 of the base 10. Conversely, the locked state is released so that the connector frame 13 can be rotated freely by moving the pivot holder 38 onto the pivot 15 on the connector frame 13.

Therefore, by simply sliding the locking member 31 provided on the base 10, the orientation of the connector frame can be easily changed.

According to the present invention as described thus far, a power-supply unit for a solenoid valve assembly wherein the orientation of the multielectrode connector is easily changed in a simple manner is provided. More specifically, a power-supply unit is provided wherein the orientation of the connector frame can be changed simply by sliding the locking member provided on the base.

What is claimed is:

1. A power-supply unit for a solenoid valve assembly comprising:

a base to be mounted on a first end of said solenoid valve assembly including a plurality of solenoid valves arranged in a row;

a connector frame to be fitted on said base; and a multielectrode connector mounted on said connector frame and electrically connected to each solenoid valve of said plurality of solenoid valves of said solenoid valve assembly for supplying power, wherein said connector frame is rotatably supported on said base so that a position of said multielectrode connector is switchable between an upright position and a horizontal position; and an engaging locking means for releasably locking said connector frame in either one of said upright position and said horizontal position, said engaging locking means being provided between said connector frame and said base, wherein said engaging locking means includes:

a pivot of circular cross section for rotatably supporting said connector frame on said base, a square pivot member attached to said pivot of circular cross section, wherein a part of said square pivot member is formed in a square shape, and a locking member mounted on said base and moving between a locked position where said locking member abuts against a flat face portion of said square pivot member and a released position where said locking member is released from said locked position.

2. The power-supply unit for a solenoid valve assembly as set forth in claim 1, wherein said locking member is movable between said locked position and said released position by providing sidd square pivot member on said connector frame at a position adjacent to and coaxial with said pivot of circular cross section, by providing said locking member with a pivot holder having a flat portion for restraining a rotation of said pivot of circular cross section when abutted against said flat face portion of said square pivot member, and by providing a final control element which enables said locking member to slide along an axis of rotation for said rotation of said pivot of circular cross section.

3. The power-supply unit for a solenoid valve assembly as set forth in claim 2, wherein said base is provided with a bearing portion that rotatably supports a lower half of said pivot of circular cross section and a flat supporting portion for supporting said square pivot member, and said pivot holder of said locking member moves between said pivot of circular cross-section and said square pivot member by a sliding movement in a direction of said axis of rotation of said pivot of circular cross section, so that said connector frame is locked in said locked position where said square pivot member is interposed between said flat portion of said pivot holder and said flat supporting portion and is rotatable at a position where an interposition of said square pivot member is released.

* * * * *